US005409794A

United States Patent [19]

Ong

[11] Patent Number: 5,409,794

[45] Date of Patent: Apr. 25, 1995

[54] TONER COMPOSITIONS WITH METAL CHELATE CHARGE ENHANCING ADDITIVES

[75] Inventor: Beng S. Ong, Mississauga, Canada

[73] Assignee: Xerox Corporation, Stamford, Conn.

[21] Appl. No.: 964,544

[22] Filed: Oct. 21, 1992

[51] Int. Cl.[6] ..... G03G 9/097

[52] U.S. Cl. ..... 430/110; 430/109

[58] Field of Search ..... 430/110, 109

[56] References Cited

U.S. PATENT DOCUMENTS

| | | | |
|---|---|---|---|
| 4,206,064 | 6/1980 | Kiuchi et al. | 430/106 |
| 4,298,672 | 11/1981 | Lu | 430/108 |
| 4,411,974 | 10/1983 | Lu et al. | 430/106 |
| 4,845,003 | 7/1989 | Kiriu et al. | 430/110 |
| 4,904,762 | 2/1990 | Chang et al. | 430/110 |
| 4,935,326 | 6/1990 | Creatura et al. | 430/108 |
| 4,937,166 | 6/1990 | Creatura et al. | 430/108 |
| 4,965,158 | 10/1990 | Gruber et al. | 430/106.6 |
| 5,213,936 | 5/1993 | Creatura et al. | 430/108 |
| 5,232,808 | 8/1993 | Bonser et al. | 430/110 |

FOREIGN PATENT DOCUMENTS

| | | | |
|---|---|---|---|
| 48-43158 | 12/1973 | Japan | 430/110 |
| 61-212852 | 9/1986 | Japan | 430/110 |
| 62-62369 | 3/1987 | Japan | 430/110 |

OTHER PUBLICATIONS

Patent & Trademark Office English Translation Of Japanese 48–43158 (Pub. Dec. 17, 1973).

*Primary Examiner*—Janis L. Dote

*Attorney, Agent, or Firm*—E. O. Palazzo

[57] ABSTRACT

A toner composition comprised of polymers, pigment particles and/or dyes, optional surface additives, and a charge enhancing additive derived from the reaction of a metal, a metal carbonyl, a metal salt, or a metal oxide, with a $\beta$-diketone, a $\beta$-keto ester, or a malonic ester in an aqueous medium or organic medium.

8 Claims, No Drawings

TONER COMPOSITIONS WITH METAL CHELATE CHARGE ENHANCING ADDITIVES

BACKGROUND OF THE INVENTION

The invention is generally directed to toner and developer compositions, and more specifically, the present invention is directed to developer and toner compositions containing charge enhancing additives, which impart or assist in imparting a negative charge to the toner particles and enable toners with rapid triboelectric charging characteristics. In embodiments, there are provided in accordance with the present invention toner compositions comprised of a polymer resin or resins, color pigment particles or dye molecules, and metal chelate charge enhancing additives. Also, in embodiments the present invention is directed to toners with metal chelate charge enhancing additives comprised of a metal coordinating to a number of organic bidentate ligands derived from β-diketones, β-keto esters, or malonic esters. These charge enhancing additives in embodiments generally possess melting points of, for example, below 300° C., excellent solubility in common organic solvents, and acceptable polymer compatibility, which promote their dispersibility in toner resins, thereby enabling, for example, stable triboelectric characteristics. The aforementioned charge additives in embodiments of the present invention enable, for example, toners with rapid triboelectric charging characteristics, extended developer life, stable triboelectrical properties irrespective of changes in environmental conditions, and high image print quality with substantially no background deposits. Also, the aforementioned toner compositions usually contain a colorant component comprised of, for example, carbon black, magnetites, or mixtures thereof, color pigments or dyes with cyan, magenta, yellow, blue, green, red, or brown color, or mixtures thereof thereby providing for the development and generation of black and/or colored images. The toner and developer compositions of the present invention can be selected for electrophotographic, especially xerographic imaging and printing processes, including color processes.

Toners with negative charge additives are known, reference, for example, U.S. Pat. Nos. 4,411,974 and 4,206,064, the disclosures of which are totally incorporated herein by reference. The '974 patent discloses negatively charged toner compositions comprised of resins, pigment particles, and as a charge enhancing additive ortho-halophenyl carboxylic acids. Similarly, there are disclosed in the '064 patent toner compositions with chromium, cobalt, and nickel complexes of salicylic acid as negative charge enhancing additives. In U.S. Pat. No. 4,845,003 there are illustrated negatively charged toners with certain aluminum salt charge additives. More specifically, this patent discloses as charge additives aluminum complexes comprised of two or three hydroxybenzoic acid ligands bonded to a central aluminum ion. While these charge additives may have the capability of imparting negative triboelectric charge to toner particles, they are generally not efficient in promoting the rate of triboelectric charging of toner particles. A rapid rate of triboelectric charging is particularly crucial for high speed xerographic machines since, for example, these machines consume toner rapidly, and fresh toner has to be constantly added. The added uncharged toners, therefore, must charge up to their equilibrium triboelectric charge level rapidly to ensure no interruption in the xerographic imaging or printing operation. Another shortcoming of these charge additives is their thermal instability, that is they often break down during the thermal extrusion process of the toner manufacturing cycle.

Developer compositions with charge enhancing additives, which impart a positive charge to toner particles, are also well known. Thus, for example, there is described in U.S. Pat. No. 3,893,935 the use of quaternary ammonium salts as charge control agents for electrostatic toner compositions; U.S. Pat. No. 4,221,856, which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example, sulfate, sulfonate, nitrate, borate, chlorate, and the halogens such as iodide, chloride and bromide, reference the Abstract of the Disclosure and column 3; a similar teaching is presented in U.S. Pat. No. 4,312,933, which is a division of U.S. Pat. No. 4,291,111; similar teachings are presented in U.S. Pat. No. 4,291,112, wherein A is an anion including, for example, sulfate, sulfonate, nitrate, borate, chlorate, and the halogens; U.S. Pat. No. 4,338,390, the disclosure of which is totally incorporated herein by reference, developer compositions containing as charge enhancing additives organic sulfate and sulfonates, which additives can impart a positive charge to the toner composition; U.S. Pat. No. 4,298,672, the disclosure of which is totally incorporated herein by reference, positively charged toner compositions with resins and pigment particles, and as charge enhancing additives alkyl pyridinium compounds.

Disclosed in patent applications U.S. Ser. No. 894,688 (D/92080), is a negatively charged toner composition comprised of a polymer or polymer resins, a colorant or colorants, optional surface additives, and a metal complex charge enhancing additive obtained from the reaction of a hydroxybenzoic acid and a base with a mixture of a metal ion and a hydroxyphenol; and U.S. Ser. No. 894,690 (D/92081), is a negatively charged toner composition comprised of a polymer or polymers, a colorant or colorants, optional surface additives, and a metal complex charge enhancing additive obtained from the reaction of a hydroxybenzoic acid and a base with a mixture of a metal ion and an aromatic dicarboxylic acid.

Although many charge enhancing additives are known, there continues to be a need for charge enhancing additives which when incorporated in toners, render the toners with many of the advantages illustrated herein. There is also a need for negative charge enhancing additives which are useful for incorporation into black and colored toner compositions which can be utilized for developing positive electrostatic latent images. Moreover, there is a need for colored toner compositions containing charge enhancing additives which do not interfere with the color quality of the colorants present in the toners. Another need relates to the provision of toner compositions with certain charge enhancing additives, which toners in embodiments thereof possess substantially stable triboelectric charge levels, and display acceptable rates of triboelectric charging characteristics. Furthermore, there is also a need for toner compositions with certain charge enhancing additives which possess excellent dispersibility characteristics in toner resins, and can therefore form stable dispersions in the toner compositions. There is also a need for negatively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference. Also, there is a need for negative toner compositions which have desirable triboelectric charge levels of preferably from between about −10 to about −40 microcoulombs per gram, and triboelectric charging rates of preferably less than 120 seconds as measured by standard charge spectrograph methods when the toners are frictionally charged against suitable carrier particles via conventional roll milling techniques. The concentrations of the charge additives that can be incorporated into the toner compositions generally range from about 0.05 weight percent to about 5 weight percent, depending on whether the charge additive is utilized as a surface additive or as a dispersion in the bulk of the toner. The effective loadings of toner in the developer, that is toner and carrier particles, are, for example, from about 0.5 to about 5 weight percent, preferably from about 1 to about 3 weight percent.

SUMMARY OF THE INVENTION

It is an object of the present invention to provide toner and developer compositions with negative charge enhancing additives.

In another object of the present invention there are provided negatively charged toner compositions useful for the development of electrostatic latent images including color images.

A further object of the present invention is to provide toner and developer compositions utilizing economical negative charge enhancing additives.

In yet a further object of the present invention there may be provided, it is believed, humidity insensitive, from about, for example, 20 to 90 percent relative humidity at temperatures of from 60° to 85° F. as determined in a relative humidity testing chamber, negatively charged toner compositions with desirable triboelectric charging rates of less than 120 seconds, and preferably less than 60 seconds, such as 15 to about 45, as determined by the charge spectrograph method, and acceptable triboelectric charging levels of from about −8 and preferably −10 to about −40 microcoulombs per gram.

Another object of the present invention resides in the preparation of negative toners which will enable the development of images in electrophotographic imaging apparatuses, which images have substantially no background deposits thereon, are substantially smudge proof or smudge resistant, and therefore are of excellent resolution; and further, such toner compositions can be selected for high speed electrophotographic apparatuses, that is for example those exceeding 50 copies per minute.

These and other objects of the present invention may be accomplished in embodiments thereof by providing toner compositions comprised of a polymer or polymer resins, colorants comprised of pigment particles or dye molecules, and certain metal chelate charge enhancing additives comprised of a metal or an electropositive element coordinating to a number of organic bidentate ligands derived from β-diketones, β-keto esters, or malonic esters. More specifically, the present invention in embodiments is directed to toner compositions comprised of resin particles, color pigment, or dye, and a metal chelate charge enhancing additive which may be described by the following formula:

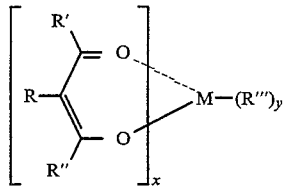

wherein R is hydrogen, alkyl, or aryl; R′ and R″ are selected from the group consisting of alkyl, alkoxy, aryl, and aryloxy; R‴ is selected from the group consisting of alkoxy, and halide such as chloride or bromide; M is a metal or electropositive element such as boron, aluminum, barium, beryllium, cadmium, calcium, cesium, chromium, cobalt, copper, gallium, iron, lithium, magnesium, manganese, potassium, scandium, sodium, titanium, vanadium, zinc, and the like; x is a number in the range of 1 to 4, and y is a number of from 0 to 2.

In embodiments, the present invention is directed to a toner composition comprised of a polymer resin, or polymer resins, pigment particles and/or dyes, optional surface additives, and a charge enhancing additive derived from the reaction of a metal, a metal carbonyl, a metal salt, or a metal oxide, with a β-diketone, a β-keto ester, or a malonic ester in an aqueous medium or organic medium; and a toner composition comprised of a polymer or polymer resins, pigment particles and/or dyes, optional surface additives, and a charge enhancing additive derived from the reaction of a metal, a metal carbonyl, a metal salt, or a metal oxide, with a β-diketone, a β-keto ester, or a malonic ester in an aqueous medium or organic medium such as acetone, tetrahydrofuran, and the like.

Examples of alkyl and alkoxy include those with 1 to about 25 carbon atoms, such as methyl, methoxy, ethyl, ethoxy, propyl, propoxy, butyl, butoxy, pentyl, pentoxy, heptyl, heptoxy, octyl, octyoxy, nonyl, nonoxy, heptyl, heptoxy, stearyl, and the like. Aryl and aryloxy include those with from 6 to about 24 carbon atoms such as phenyl, phenoxy, naphthyl, naphthoxy, and the like.

The aforementioned charge additives can be incorporated into the toner, may be present on the toner surface, or may be present on toner surface additives such as colloidal silica particles. Advantages of rapid triboelectric charging characteristics of generally less than about 120 seconds, and preferably less than about 60 seconds in embodiments as measured by the standard charge spectrograph methods when the toners are frictionally charged against carrier particles by known conventional roll mixing methods, appropriate triboelectric charge levels, and the like can be achieved with many of the aforementioned toners of the present invention. In another embodiment of the present invention, there are provided, subsequent to known micronization and classification, toner particles with a volume average diameter of from about 3 to about 20 microns.

The metal chelate charge enhancing additives of the present invention are generally available, or they can be prepared by the reaction of a metal, a metal carbonyl compound, a metal salt, or a metal oxide with a β-diketone, a β-keto ester, or a malonic ester in an aqueous or suitable organic medium. An optional base, such as sodium hydroxide can be selected to react with the β-diketone, β-keto ester, or malonic ester. Illustrative metal salts that can be selected as precursors include metal halides, metal alkoxides, metal carbonates, metal carboxylates, metal hydroxides, metal nitrates, metal sulfates, and the like. Exemplary preparative procedures for these metal chelate compounds have been summarized by A. E. Siedle in *Comprehensive Coordination Chemistry,* Volume 2, Chapter 15.4, pages 365 to 412, Pergamon Press, New York, 1987, the disclosure of which is totally incorporated herein by reference.

The toner compositions of the present invention can be prepared by a number of known methods such as admixing and heating polymer resins such as styrene butadiene copolymers, colorants such as color pigment particles or dye compounds, and the aforementioned metal chelate charge enhancing additive, or mixtures of charge additives in a concentration preferably ranging from about 10 and more preferably about 0.5 percent to about 5 percent, in a toner extrusion device, such as the ZSK53 available from Werner Pfleiderer, and removing the resulting toner composition from the device. Subsequent to cooling, the toner composition is subjected to grinding utilizing, for example, a Sturtevant micronizer for the purpose of achieving toner particles with a volume average diameter of from about 2 to about 20 microns, and preferably from about 3 to about 12 microns, which diameters are determined by a Coulter Counter. Subsequently, the toner compositions can be classified utilizing, for example, a Donaldson Model B classifier for the purpose of removing unwanted fine toner particles.

Illustrative examples of metal chelate charge enhancing additives of the present invention include zinc (II) acetylacetonate (1), zinc (II) benzoylacetonate (2), zinc (II) 3-phenyl-2,4-pentanedionate (3), chromium (III) acetylacetonate (4), cobalt (II) benzoylacetonate (5), copper (II) 3-methyl-2,4-pentanedionate (6), copper (II) hexafluoroacetylacetonate (7), copper (II) hexamethylacetylacetonate (8), ferric acetylacetonate (9), manganese (II) methoxycarbonylacetonate (10), nickel (II) tetramethylacetylacetonate (11), lithium acetylacetonate (12), titanium (IV) butoxybis(acetylacetonate) (13), titanyl acetylacetonate (14), vanadium (III) acetylacetonate (15), vanadyl acetylacetonate (16), aluminum (III) acetylacetonate (17), barium (II) acetylacetonate (18), and the like.

(1)

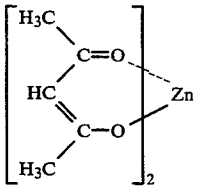

-continued (2)

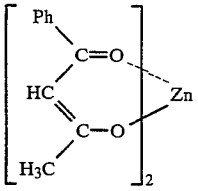

(3)

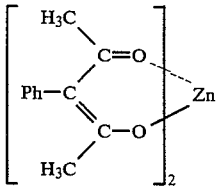

(4)

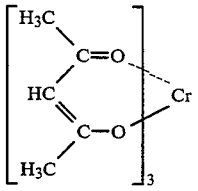

(5)

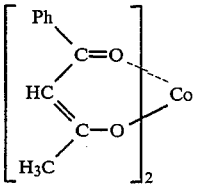

(6)

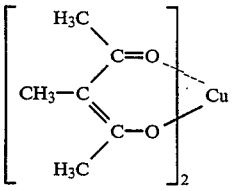

(7)

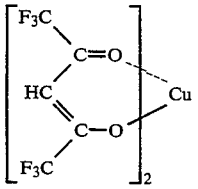

(8)

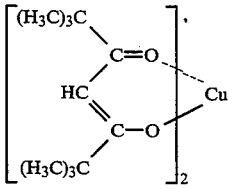

(9)

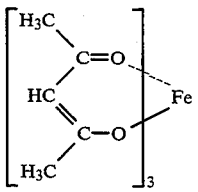

-continued (10)

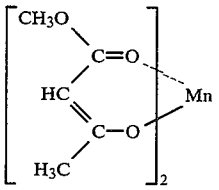

(11)

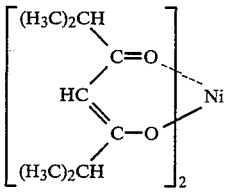

(12)

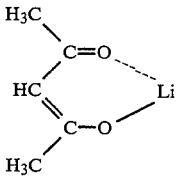

(13)

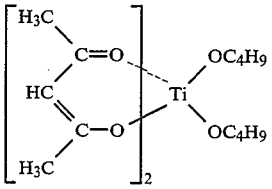

(14)

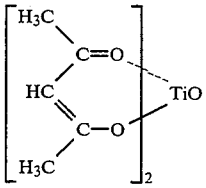

(15)

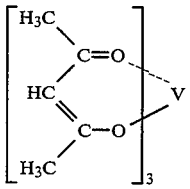

(16)

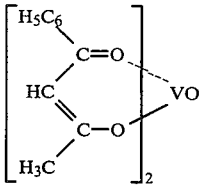

(17)

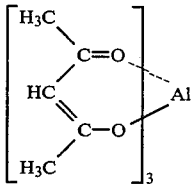

-continued (18)

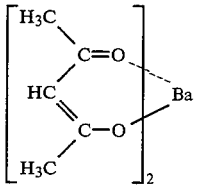

Illustrative examples of suitable toner resins selected for the toner and developer compositions of the present invention include vinyl polymers such as styrene polymers, acrylonitrile polymers, vinyl ether polymers, acrylate and methacrylate polymers; styrene acrylates, styrene methacrylates, styrene butadienes; epoxy polymers; polyurethanes; polyamides and polyimides; polyesters; and the like. The polymer resins selected for the toner compositions of the present invention include homopolymers or copolymers of two or more monomers. Furthermore, the above mentioned polymer resins may also be crosslinked depending on the desired toner properties. Illustrative vinyl monomer units in the vinyl polymer resins include styrene, substituted styrenes such as methyl styrene, chlorostyrene, methyl acrylate and methacrylate, ethyl acrylate and methacrylate, propyl acrylate and methacrylate, butyl acrylate and methacrylate, pentyl acrylate and methacrylate, butadiene, vinyl chloride, acrylonitrile, acrylamide, alkyl vinyl ether and the like. Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of the diol units in the polyester resins include ethanediol, propanediols, butanediols, pentanediols, pinacols, cyclopentanediols, hydrobenzoins, bis(hydroxyphenyl)alkanes, dihydroxybiphenyls, substituted dihydroxybiphenyls, and the like.

As a toner resin, there are selected polyester resins derived from a dicarboxylic acid and a diphenol. These resins are illustrated in U.S. Pat. No. 3,590,000, the disclosure of which is totally incorporated herein by reference; polyester resins obtained from the reaction of bisphenol A and propylene oxide, followed by the reaction of the resulting product with fumaric acid, and branched polyester resins resulting from the reaction of dimethylterephthalate with 1,3-butanediol, 1,2-propanediol, and pentanetriol. Further, low melting polyesters, especially those prepared by reactive extrusion, reference U.S. Ser. No. 814,641 (D/91117), and U.S. Pat. No. 5,227,460 (D/91117Q), the disclosures of which are totally incorporated herein by reference, can be selected as toner resins. Other specific toner resins include styrene-methacrylate copolymers, and styrene-butadiene copolymers; PLIOLITES ®; suspension polymerized styrene-butadienes, reference U.S. Pat. No. 4,558,108, the disclosure of which is totally incorporated herein by reference. Also, waxes with a molecular weight of from about 1,000 to about 7,000, such as polyethylene, polypropylene, and paraffin waxes, can be included in or on the toner compositions as fuser roll release agents.

The polymer resins are present in a sufficient, but effective amount, for example from about 30 to about 98 weight percent. Thus, when 1 percent by weight of the charge enhancing additive is present, and 10 percent by weight of colorant, such as carbon black or color pigment, is contained therein, about 89 percent by weight of resin is selected. Also, the charge enhancing additive of the present invention may be applied as a surface coating on the toner particles. When used as a coating, the charge enhancing additive of the present invention is present in an amount of from about 0.05 weight percent to about 5 weight percent, and preferably from about 0.1 weight percent to about 1.0 weight percent.

Numerous well known suitable color pigments or dyes can be selected as the colorant for the toner compositions including, for example, carbon black, like REGAL 330®, nigrosine dye, metal phthalocyanines, aniline blue, magnetite, or mixtures thereof. The colorant, which is preferably carbon black or other color pigments, should be present in a sufficient amount to render the toner composition with a sufficiently high color intensity. Generally, the colorants are present in amounts of from about 1 weight percent to about 20 weight percent, and preferably from about 2 to about 10 weight percent based on the total weight of the toner composition; however, lesser or greater amounts of colorant can be selected.

When the colorants are comprised of magnetites or a mixture of magnetites and color pigment particles, thereby enabling single component toners and toners for magnetic ink character recognition (MICR) applications in some instances, which magnetites are a mixture of iron oxides ($FeO.Fe_2O_3$) including those commercially available as MAPICO BLACK TM, they are present in the toner composition in an amount of from about 5 weight percent to about 60 weight percent, and preferably in an amount of from about 10 weight percent to about 50 weight percent. Mixtures of carbon black and magnetite with from about 1 to about 15 weight percent of carbon black, and preferably from about 2 to about 6 weight percent of carbon black, and magnetite, such as MAPICO BLACK TM, in an amount of, for example, from about 5 to about 60, and preferably from about 10 to about 50 weight percent can be selected for black toner compositions of the present invention.

There can also be blended with the toner compositions of the present invention external additives including flow aid additives, which additives are usually present on the surface thereof. Examples of these additives include colloidal silicas such as AEROSIL®, metal salts and metal salts of fatty acids inclusive of zinc stearate, aluminum oxides, cerium oxides, titanium oxides, and mixtures thereof, which additives are generally present in an amount of from about 0.1 percent by weight to about 5 percent by weight, and preferably in an amount of from about 0.25 percent by weight to about 2 percent by weight. Several of the aforementioned additives are illustrated in U.S. Pat. Nos. 3,590,000 and 3,800,588, the disclosures of which are totally incorporated herein by reference.

With further respect to the present invention, colloidal silicas such as AEROSIL® can be surface treated with the metal chelate charge additives of the present invention illustrated herein in an amount of from about 1 to about 50 weight percent and preferably 10 weight percent to about 25 weight percent followed by the addition thereof to the toners in an amount of from 0.1 to 10 and preferably 0.1 to 5 weight percent.

Also, there can be included in the toner compositions of the present invention low molecular weight waxes, such as polypropylenes and polyethylenes commercially available from Allied Chemical and Petrolite Corporation, EPOLENE N-15 TM commercially available from Eastman Chemical Products, Inc., VISCOL 550-P TM, a low weight average molecular weight polypropylene available from Sanyo Kasei K. K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent No. 1,442,835, the disclosure of which is totally incorporated herein by reference. These low molecular weight wax materials are present in the toner composition of the present invention in various amounts, however, generally these waxes are present in the toner composition in an amount of from about 1 percent by weight to about 15 percent by weight, and preferably in an amount of from about 2 weight percent to about 10 weight percent.

Encompassed within the scope of the present invention are colored toner and developer compositions comprised of toner resins, the charge enhancing additives illustrated herein, optional surface additives, and as colorants red, blue, green, brown, magenta, cyan and/or yellow dyes or color pigments, as well as mixtures thereof. More specifically, with regard to the generation of color images utilizing a developer composition with the charge enhancing additives of the present invention, illustrative examples of magenta colorants that may be selected include, for example, 2,9-dimethyl-substituted quinacridone and anthraquinone dye identified in the Color Index as Cl 60710, Cl Dispersed Red 15, diazo dye identified in the Golor Index as Cl 26050, Cl Solvent Red 19, and the like. Illustrative examples of cyan colorants that may be used include copper phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow colorants that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned colorants are incorporated into the toner composition in various suitable effective amounts providing the objectives of the present invention are achieved. In one embodiment, these colorants are present in the toner composition in an amount of from about 1 percent by weight to about 15 percent by weight based on the total weight of the toner.

For the formulation of developer compositions, there are mixed with the toner particles carrier components, particularly those that are capable of triboelectrically assuming an opposite polarity to that of the toner composition. Accordingly, the carrier particles of the present invention are selected to be those which would render the toner particles negatively charged while acquiring a positive charge polarity themselves via frictional charging against the toner particles of the present invention. The opposite charge polarities of the carrier and toner particles of the developer composition thus ensure the toner particles to adhere to and surround the carrier particles. Illustrative examples of carrier particles include iron powder, steel, nickel, iron, ferrites, including copper zinc ferrites, nickel zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxysilane, reference U.S. Pat. Nos. 3,526,533 and 3,467,634, the disclosures of which are totally incorporated herein by reference; polymethyl methacrylates; polyvinylidene fluoride other known coatings; and the like. The carrier particles may also include in the coating, which coating can be present in one embodiment in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example KYNAR ® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000, and preferably from between about 80 and 200 microns in volume average diameter thereby permitting them, for example, to possess sufficient density and inertia to avoid adherence to the electrostatic images during the development process. The carrier component can be mixed with the toner composition in various suitable combinations, such as about 0.5 to 5 parts of toner to about 100 parts by weight of carrier.

The toner composition of the present invention can be prepared by a number of known methods including extrusion melt blending the toner resins, colorants, and the charge enhancing additive of the present invention as indicated herein, followed by mechanical attrition and classification. Other methods include those well known in the art such as spray drying, melt dispersion, extrusion processing, dispersion polymerization, and suspension polymerization. Also, as indicated herein the toner composition without the charge enhancing additive can be first prepared, followed by addition of the charge enhancing additives and other optional surface additives, or the charge enhancing additive-treated surface additives such as colloidal silicas. Further, other methods of preparation for the toner are as illustrated herein.

The toner and developer compositions of the present invention may be selected for use in electrostatographic imaging and printing apparatuses containing therein conventional photoreceptors providing that they are capable of forming positive electrostatic latent images relative to the triboelectric charge polarity of the toners.

The toners of the present invention are usually jetted and classified subsequent to preparation to enable toner particles with a preferred volume average diameter of from about 2 to about 20 microns, and preferably from about 3 to about 12 microns. The triboelectric charging rates for the toners of the present invention are preferably less than 120 seconds, and more specifically, less than 60 seconds in embodiments thereof as determined by the known charge spectrograph method as described hereinbefore. These toner compositions with rapid rates of triboelectric charging characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 50 copies per minute.

The following Examples are being supplied to further illustrate various embodiments of the present invention, it being noted that these Examples are intended to illustrate and not limit the scope of the present invention. Comparative Examples are also presented.

SYNTHESIS OF CHARGE ENHANCING ADDITIVES

The metal chelate charge enhancing additives of the present invention can be prepared by the known literature procedures as summarized in *Comprehensive Coordination Chemistry,* Volume 2, Chapter 15.4, pages 365 to 412, published by Pergamon Press, New York, 1987, the disclosure of which is totally incorporated herein by reference. Specifically, the zinc chelate charge additives such as zinc (II) acetylacetonate (1), zinc (II) benzoylacetonate (2), and zinc (II) 3-phenyl-2,4-pentanedionate (3) were prepared according to the procedure as published in the *Journal, Inorganic Chemistry,* Volume 8, Number 6, pages 1312 to 1319, 1969, the disclosure of which is totally incorporated herein by reference.

EXAMPLE I

There was prepared in an extrusion device, available as ZSK-30 from Werner Pfleiderer, a toner composition by adding thereto 94.0 weight percent of a suspension polymerized styrene butadiene resin, reference U.S. Pat. No. 4,558,108, the disclosure of which is totally incorporated herein by reference, and 6.0 weight percent of REGAL 330 ® carbon black. The toner composition was extruded at a rate of 20 pounds per hour at a temperature of about 130° C. with a screw speed of 200 rpm. The strands of melt mixed product exiting from the extruder were air cooled, pelletized in a Berlyn Pelletizer and then fitzmilled in a Model J Fitzmill. The toner product was then subjected to grinding in a Sturtevant micronizer. Thereafter, the aforementioned toner particles were classified in a Donaldson Model B classifier for the purpose of removing fine particles, that is those with a volume average diameter of less than 4 microns. The resulting toner had a volume average particle diameter of 10.6 microns, and a particle size distribution of 1.22 as measured by a Coulter Counter. Subsequently, the toner was surface coated with 0.25 weight percent of the charge enhancing additive, zinc (II) acetylacetonate, by a conventional dry blending method for 30 to 60 seconds.

The above treated toner was equilibrated at room temperature under a 50 percent relative humidity condition for 24 hours. A developer was then prepared by blending 2.0 weight percent of the surface treated toner with 98.0 weight percent of a carrier containing a nickel zinc ferrite core and 0.9 weight percent of a polymer composite coating comprised of 80 weight percent of a methyl terpolymer and 20 weight percent of Vulcan XC72R carbon black. The methyl terpolymer is comprised of about 81 weight percent of polymethyl methacrylate and 19 weight percent of a styrene vinyltriethoxysilane polymer. The developer was roll milled for 30 minutes to generate the time zero developer, and the triboelectric charge of the toner of the resulting developer was measured to be −11.6 microcoulombs per gram by the standard blow-off technique in a Faraday Cage apparatus. To measure the rate of triboelectric charging of toner, 1.0 weight percent of the uncharged toner was added to the time zero developer, and the charge distribution of the toner of the resulting developer was measured as a function of the blending time via roll milling using a charge spectrograph. The time required for the toner of the resulting developer to attain a charge distribution similar to that of the toner of the time zero developer was taken to be the rate of charging of the toner. For this toner, the rate of charging was less than 120 seconds.

COMPARATIVE EXAMPLE (A)

A comparative black toner with a commercial charge enhancing additive, BONTRON E-88 TM obtained from Orient Chemicals, which is believed to be an anionic complex of an anion of two 3,5-di-tertbutylsalicylic acid ligands bonded to a central aluminum atom, and a countercation of proton or alkaline metal ion, was prepared by blending the untreated toner (no charge additive) of Example I with 0.25 weight percent of BONTRON E-88 TM, and a developer was then prepared from this toner in accordance with the procedure of Example ]:. The toner exhibited a triboelectric charge of −35.9 microcoulombs per gram, and its rate of charging was measured to be about 5 minutes.

EXAMPLE II

A black toner was prepared in accordance with the procedure of Example I using 0.10 weight percent of the charge enhancing additive, zinc (II) benzoylacetonate, instead of zinc (II) acetylacetonate. A developer was then prepared with this toner in the same manner as in Example I. The toner had a triboelectric charge of −14.5 microcoulombs per gram, and a rate of charging of about 60 seconds.

COMPARATIVE EXAMPLE (B)

A comparative black toner with 0.10 weight percent of the commercial charge enhancing additive, BONTRON E-88 TM obtained from Orient Chemicals, was prepared by blending the untreated toner of Example I with 0.10 weight percent of BONTRON E-88 TM, and a developer was then prepared with this toner in accordance with the procedure of Example I. The toner exhibited a triboelectric charge level of −15.2 microcoulombs per gram, and its rate of charging was measured to be about 5 minutes.

EXAMPLE III

A black toner with 0.25 weight percent of zinc (II) 3-phenyl-2,4-pentanedionate as a charge enhancing additive was prepared in accordance with the procedure of Example I by utilizing zinc (II) 3-phenyl-2,4-pentanedionate instead of zinc (II) acetylacetonate. A developer was then prepared with this toner. The toner displayed a triboelectric charge of −17.2 microcoulombs per gram, and its rate of charging was measured to be about 60 seconds.

COMPARATIVE EXAMPLE (C)

A comparative black toner with 0.25 weight percent of the commercial charge enhancing additive, BONTRON E-84 TM obtained from Orient Chemicals, which is believed to be comprised of an anion of two 3,5-di-tert-butylsalicylic acid ligands bonded to a central zinc atom, and a countercation of proton or alkaline metal ion, was prepared by blending the untreated toner of Example I with 0.25 weight percent of BONTRON E-84 TM, and a developer was then prepared with this toner in accordance with the procedure of Example I. The toner exhibited a triboelectric charge of −25.6 microcoulombs per gram, and its rate of charging was measured to be about 10 minutes.

EXAMPLE IV

A blue toner comprised of 93.0 weight percent of SPAR II TM polyester resin, 2.0 weight percent of PV FAST BLUE TM pigment, and 5.0 weight percent of the charge enhancing additive, 3-phenyl-2,4-pentanedionate, was prepared by melt blending these three components, followed by micronizing and classifying in accordance with the procedure of Example I. The resulting toner had a volume average particle diameter of 10.2 microns, and a particle size distribution of 1.27. A developer was prepared with this toner using 2.0 weight percent of toner and a carrier containing a steel core and 0.8 weight percent of a polymer composite coating comprised of 80 weight percent of polymethyl methacrylate and 20 weight percent of VULCAN XC72 TM carbon black. The toner displayed a triboelectric charge of −12.1 microcoulombs per gram, and its rate of charging was measured to be about 2 minutes.

The toner was then surface coated with 0.5 weight percent of AEROSIL R972 ® by a conventional dry blending method, and a developer was prepared with this toner and the above carrier particles as before. The triboelectric charge of this toner was measured to be −16.2 microcoulombs per gram, and its rate of charging was 30 seconds.

COMPARATIVE EXAMPLE (D)

A comparative blue toner and developer composition with a commercial charge additive, BONTRON E-84 TM, were prepared in accordance with the procedure of Example IV except that BONTRON E-84 TM was utilized in place of 3-phenyl-2,4-pentanedionate. The toner displayed a triboelectric charge of −18.5 microcoulombs per gram, and its rate of charging was about 10 minutes.

Other modifications of the present invention may occur to those skilled in the art subsequent to a review of the present application. The aforementioned modifications, including equivalents thereof, are intended to be included within the scope of the present invention.

What is claimed is:

1. A toner composition consisting of a polymer or polymers, a pigment, and a charge enhancing additive of the following formula

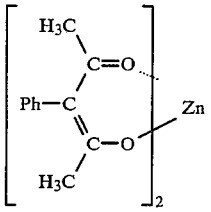

wherein Ph represents a phenyl group.

2. A toner composition in accordance with claim 1 wherein the charge additive is present in an amount of from about 0.5 to about 5 weight percent.

3. A toner composition in accordance with claim 1 wherein the toner's rate of charging is less than about 120 seconds as measured by the standard charge spectrograph method.

4. A toner composition in accordance with claim 1 with a negative triboelectric charge of from between about −10 to about −40 microcoulombs per gram.

5. A toner composition in accordance with claim 1 wherein the polymer or polymers are comprised of styrene polymers.

6. A toner composition in accordance with claim 1 wherein the pigment is carbon black, magnetites, or mixtures thereof, cyan, magenta, yellow, red, blue, green, brown dye or pigment, or mixtures thereof.

7. A toner composition in accordance with claim 6 wherein the charge additive is present in an amount of from about 0.5 to about 5 weight percent.

8. A developer dry composition comprised of the toner composition of claim 1 and carrier particles.

* * * * *